US008375870B2

(12) United States Patent
Hsieh

(10) Patent No.: US 8,375,870 B2
(45) Date of Patent: Feb. 19, 2013

(54) DETACHABLE TABLE DEVICE

(75) Inventor: Duan-Cheng Hsieh, Taipei (TW)

(73) Assignee: Habitex Corporation (TW)

( * ) Notice: Subject to any disclaimer, the term of this patent is extended or adjusted under 35 U.S.C. 154(b) by 274 days.

(21) Appl. No.: 12/872,557

(22) Filed: Aug. 31, 2010

(65) Prior Publication Data

US 2012/0048157 A1 Mar. 1, 2012

(51) Int. Cl.
*A47B 3/00* (2006.01)

(52) U.S. Cl. ..... 108/122; 108/157.15

(58) Field of Classification Search ..... 248/150, 248/163.1, 166, 167; 108/121, 122, 127, 108/115, 157.1, 157.15–157.17, 159, 159.12, 108/158.12
See application file for complete search history.

(56) References Cited

U.S. PATENT DOCUMENTS 1,652,942 A * 12/1927 James ..... 108/159
1,997,660 A * 4/1935 Smith ..... 108/157.15
2,324,252 A * 7/1943 Woelfer ..... 108/157.15
3,366,079 A * 1/1968 Koransky et al. ..... 108/157.15
3,379,145 A * 4/1968 Lieberman ..... 108/166
4,315,467 A * 2/1982 Vanderminden ..... 108/157.15
4,805,541 A * 2/1989 Drane et al. ..... 108/27
4,823,709 A * 4/1989 Tesney ..... 108/157.15
4,905,612 A * 3/1990 Apissomian ..... 108/157.15
5,471,800 A * 12/1995 Hill et al. ..... 52/239
2008/0169389 A1* 7/2008 Hill ..... 248/166
2012/0000402 A1* 1/2012 Mangas et al. ..... 108/159.11

* cited by examiner

*Primary Examiner* — Janet M Wilkens
(74) *Attorney, Agent, or Firm* — Stroock & Stroock & Lavan LLP

(57) ABSTRACT

A detachable table device includes a foldable leg device detachably connected to a table top and operable to support the table top when in an extended state and to separate from the table top when in a folded state. A circumferential portion of the table top has an inner annular surface formed with a radially and outwardly extending annular engaging groove. The leg device includes a pivot unit for interconnecting at least three leg members such that the leg members are pivotable relative to the pivot unit to be angularly equidistant when the leg device is in the extended state, and to be moved toward each other when the leg device is in the folded state. Each leg member includes an engaging end portion disposed movably in and engaging releasably the engaging groove in the circumferential portion of the table top.

4 Claims, 6 Drawing Sheets

DETACHABLE TABLE DEVICE

BACKGROUND OF THE INVENTION

1. Field of the Invention

The invention relates to a table device, and more particularly, to a detachable table device.

2. Description of the Related Art

Generally, a conventional table device with unfolded legs occupies a relatively large area when not in use. Therefore, it is inconvenient to store and carry. In addition, tools are required to assemble or disassemble such a table device.

SUMMARY OF THE INVENTION

Therefore, the object of the present invention is to provide a detachable table device that occupies a relatively small amount of space when not in use, and that has a foldable leg device which can be manually attached to or detached from a table top without tools.

According to the present invention, a detachable table device comprises:

a table top having a circumferential portion, the circumferential portion having an inner annular surface formed with a radially and outwardly extending annular engaging groove; and a foldable leg device detachably connected to the tabletop and operable between an extended state, where the table top is supported on the leg device, and a folded state, where the table top is detachable from the leg device, the leg device including a number (N) of leg members, where N≧3, each of the leg members including an engaging end portion that is disposed movably in and engages releasably the engaging groove in the circumferential portion of the table top, and a pivot unit for interconnecting the leg members such that the leg members are pivotable relative to the pivot unit to be angularly equidistant when the leg device is in the extended state, and to be moved toward each other when the leg device is in the folded state.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
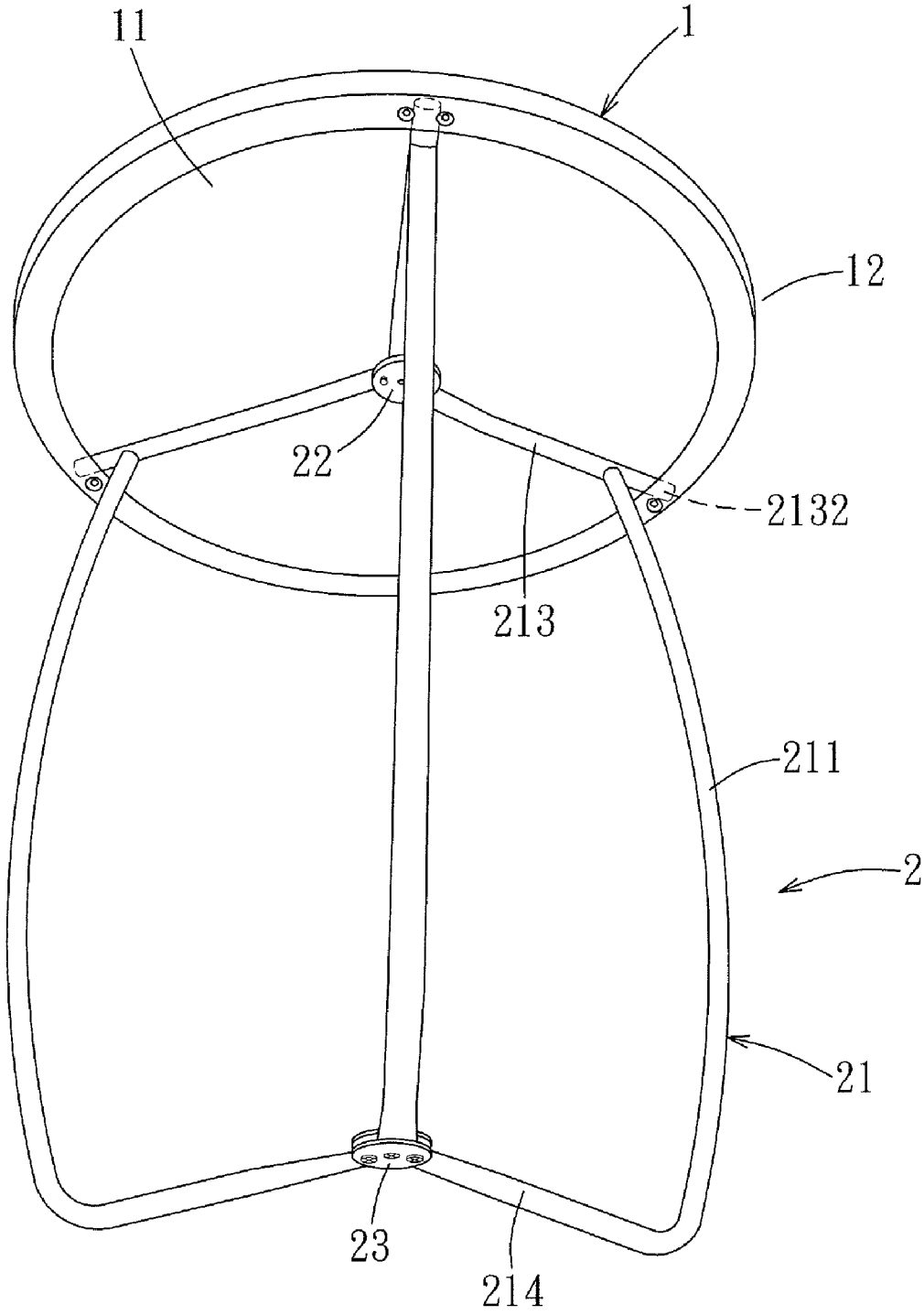
FIG. 1 is an assembled perspective view showing the first preferred embodiment of a detachable table device according to the present invention.

Before the present invention is described in greater detail, it should be noted that like elements are denoted by the same reference numerals throughout the disclosure.

Figure 2:
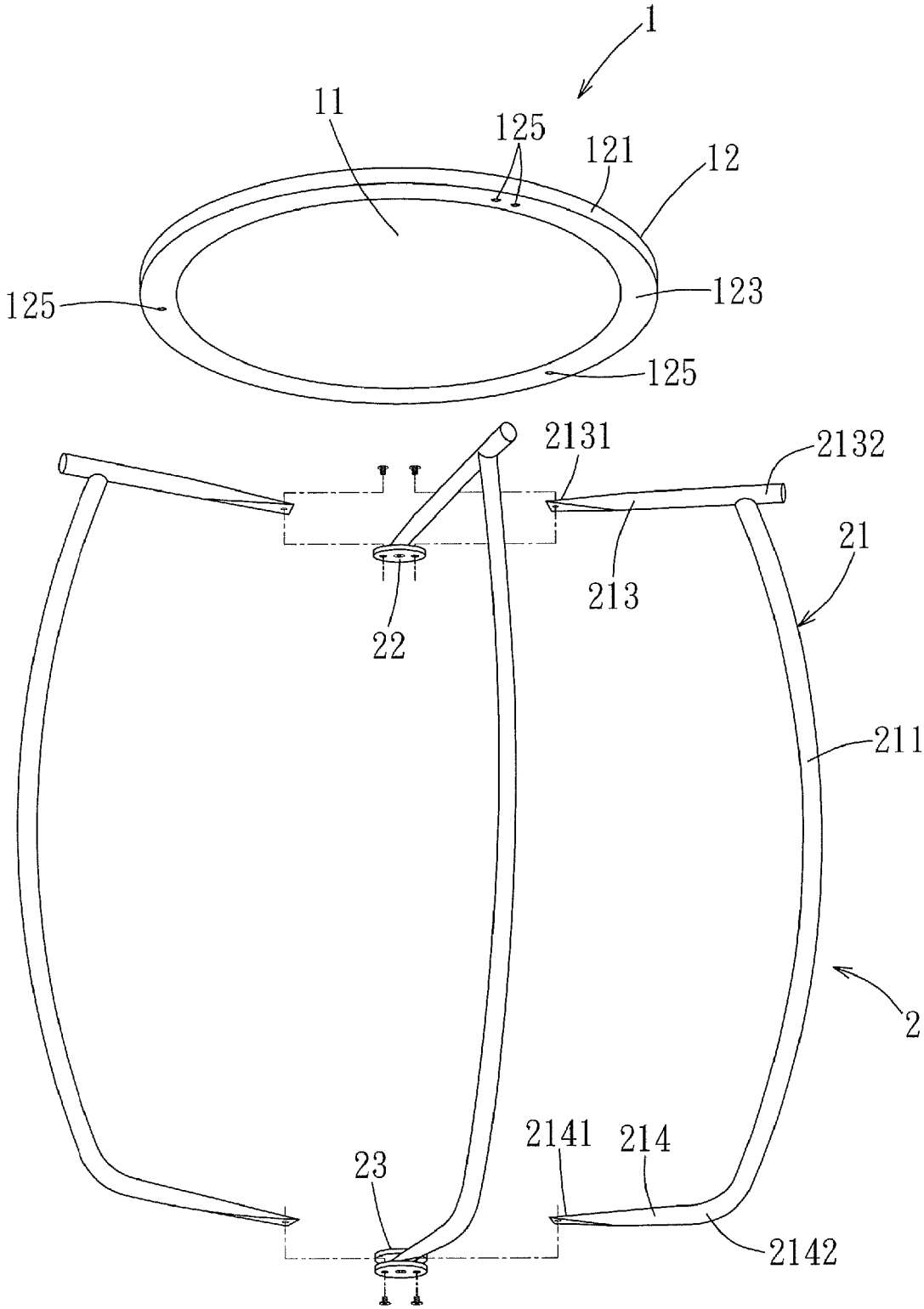
FIG. 2 is a partly exploded perspective view showing the first preferred embodiment.
Figure 5:
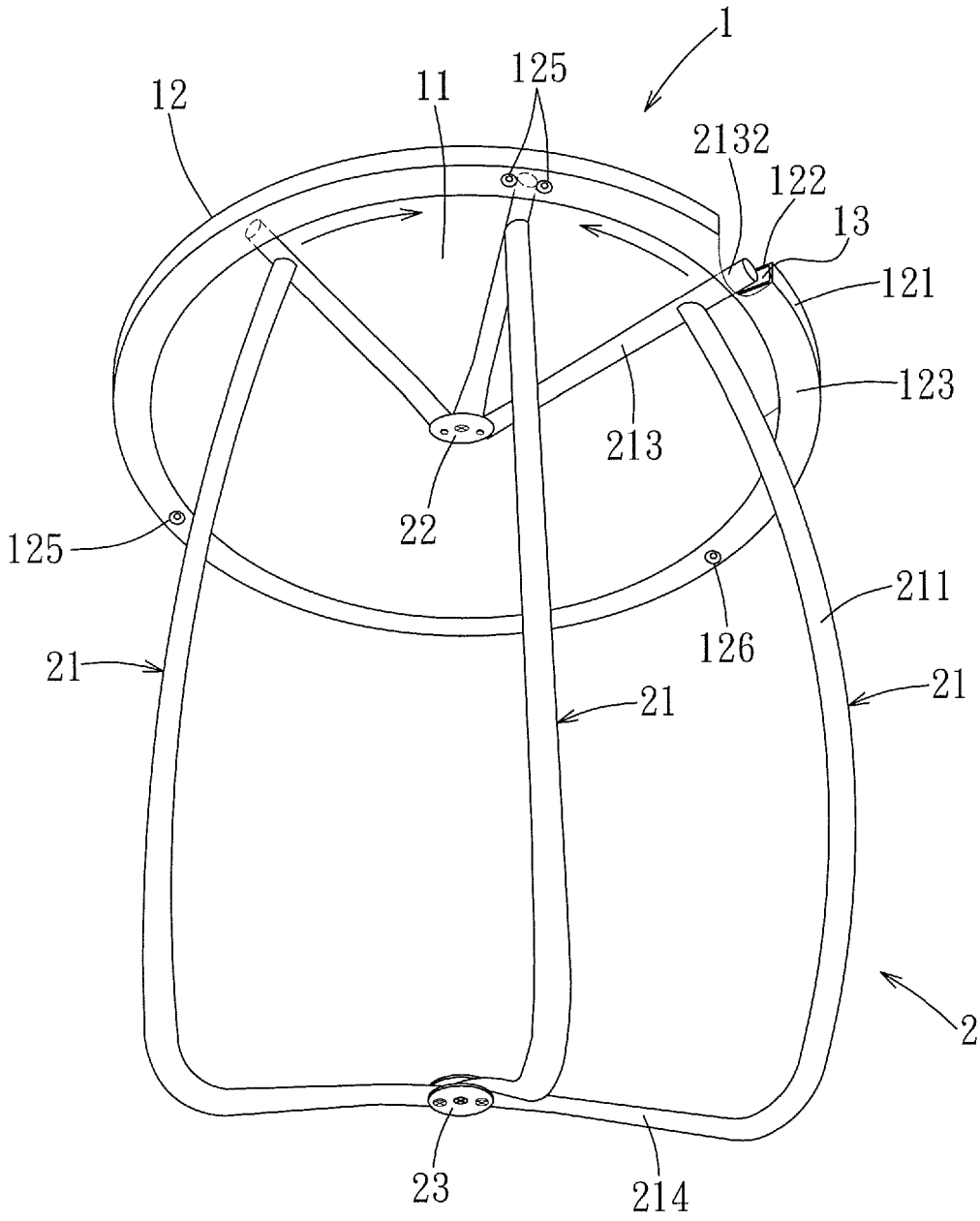
FIG. 5 is a perspective, partly cutaway view showing the first preferred embodiment when in a folded state.

Referring to FIGS. 1, 2 and 5, the first preferred embodiment of a detachable table device according to the present invention is shown to include a table top 1, and a foldable leg device 2.

Figure 3:
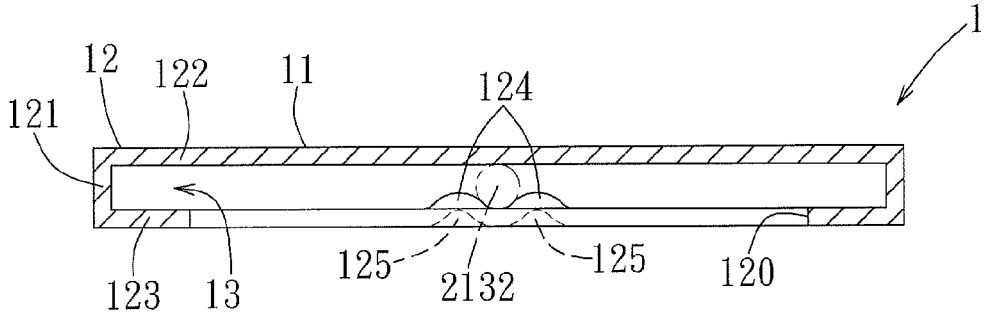
FIG. 3 is a schematic sectional view showing a table top of the first preferred embodiment.

Referring further to FIG. 3, the table top 1 has a circular top plate portion 11, and a circumferential portion 12 connected integrally to the top plate portion 11. The circumferential portion 12 has an inner annular surface 120 formed with a radially and outwardly extending annular engaging groove 13. The annular engaging groove 13 is defined among an annular top wall 122, an annular bottom wall 123, and an annular side wall 121 interconnecting the annular top and bottom walls 122, 123. In this embodiment, the circumferential portion 12 is formed with a plurality of bumps 124 (only two are shown in FIG. 3) that are disposed spacedly in the engaging groove 13 and that project from the annular bottom wall 123 toward the annular top wall 122. In addition, the bumps 124 are formed by pressing the annular bottom wall 123 such that recesses 125 corresponding to the bumps 124 are formed in a bottom surface of the bottom wall 123.

Figure 4:
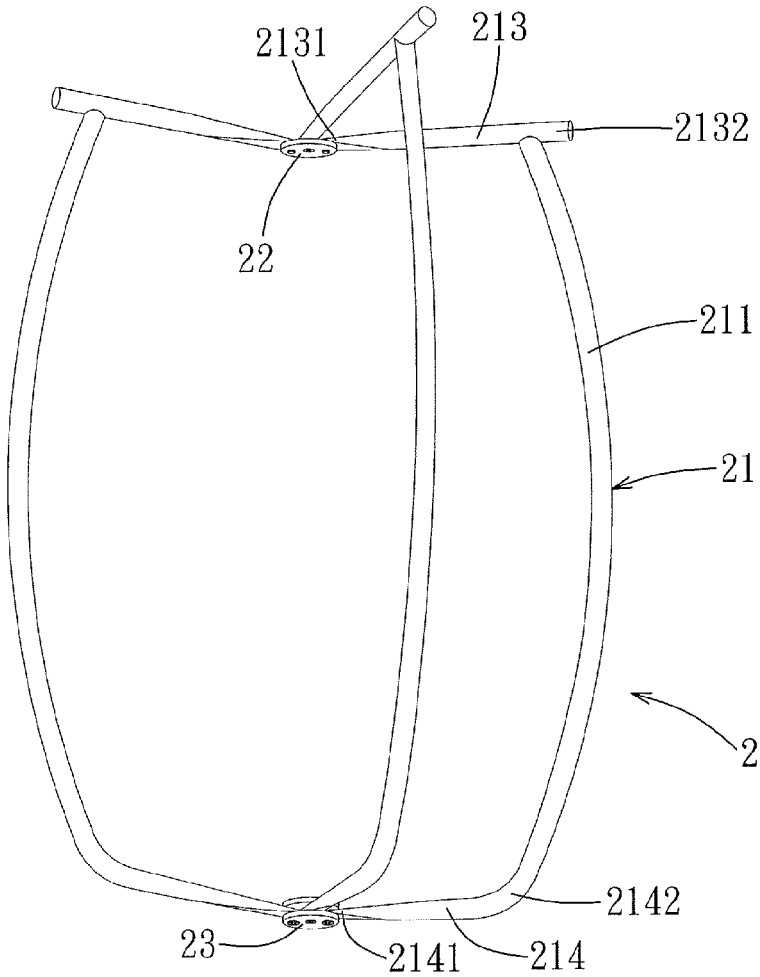
FIG. 4 is a perspective view showing a foldable leg device of the first preferred embodiment.

Referring further to FIG. 4, the foldable leg device 2 is detachably connected to the table top 1, and is operable between an extended state, where the table top is supported on the leg device 2, as shown in FIG. 1, and a folded state, where the table top 1 is detachable from the leg device 2. The leg device 2 includes three leg members 21, and a pivot unit.

In this embodiment, each leg member 21 includes an upper connecting rod 213, a supporting rod and a lower connecting rod 214. The upper connecting rod 213 has a first end portion 2131, and a second end portion 2132 opposite to the first end portion 2131 and serving as an engaging end portion that is disposed movably in and engages releasably the engaging groove 13 in the circumferential portion 12 of the table top 1. The supporting rod 211 is transverse to the upper connecting rod 213 and is connected to the upper connecting rod 213 at a top end thereof. The lower connecting rod 214 has a first end 2141, and a second end 2142 opposite to the first end 2141 and connected integrally to a bottom end of the supporting rod 211.

The pivot unit interconnects the leg members 21 such that the leg members 21 are pivotable relative to the pivot unit to be angularly equidistant when the leg device 2 is in the extended state (see FIG. 1), and to be moved toward each other when the leg device 2 is in the folded state (see FIG. 5). In this embodiment, the pivot unit includes an upper pivot disc 22, and a lower pivot seat 23. The upper pivot disc 22 is disposed on the bottom of the table top 1, and is connected pivotally to the first end portions 2131 of the upper connecting rods 213 of the leg members 21. The lower pivot seat 23 is disposed under and is aligned with the upper pivot disc 22. The lower pivot seat 23 is connected pivotally to the first ends 2141 of the lower connecting rods 214 of the leg members 21.

It is noted that the bumps 124 of the circumferential portion 12 of the table top 1 are arranged so that the engaging end portion 2132 of one leg member 21 is positioned between a corresponding adjacent pair of the bumps 124 and that the engaging end portions 2132 of the other leg members 21 are positioned by corresponding bumps 124, respectively, when the leg device 2 is switched to the extended state, as shown in FIG. 1. As a result, angularly equidistant arrangement of the leg members 21 can be maintained when the leg device 2 is in the expended state.

Figure 6:
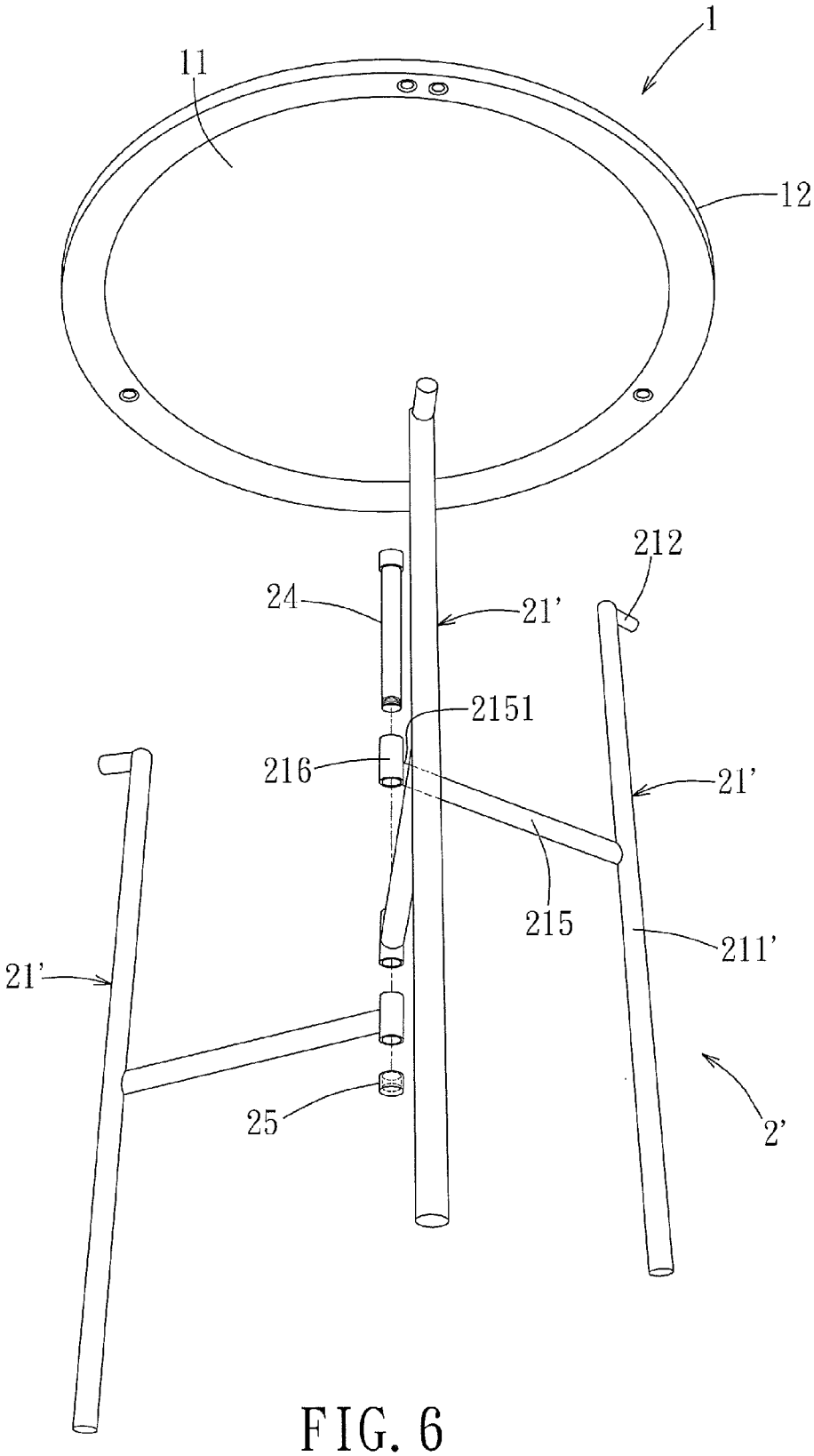
FIG. 6 is an exploded perspective view showing the second preferred embodiment of a detachable table device according to the present invention.
Figure 7:
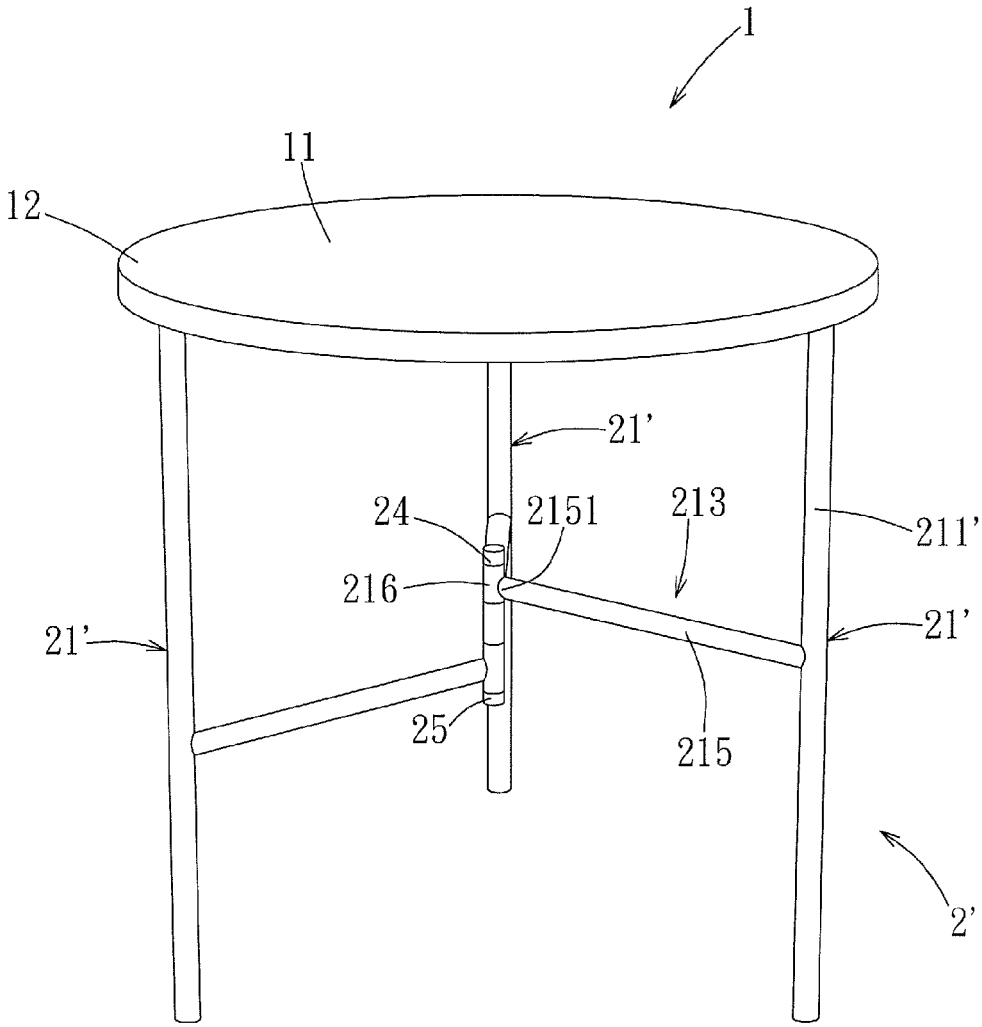
FIG. 7 is a perspective view showing the second preferred embodiment when in a state of use.

FIGS. 6 and 7 illustrate the second preferred embodiment of a detachable table device according to this invention, which is a modification of the first preferred embodiment. In this embodiment, each leg member 21' of the foldable leg device 2' includes an upright led rod 211', an engaging rod 212 extending from a top of the leg rod 211' into the engaging groove in the table top 1 and serving as the engaging end portion, a connecting rod 215 transverse to the leg rod 211 and having a pivot end 2151, and a vertically extending sleeve 216 connected fixedly to the pivot end 2151 of the connecting rod 215. The sleeves 216 of the leg members 21' are aligned with each other and are stacked in a vertical direction. In addition, the pivot unit includes a pivot bolt 24 extending through the sleeves 216 of the leg members 21', and a nut 25 connected threadedly to an end of the pivot bolt 24 such that the leg members 21' are limited to be rotatable about the pivot bolt 24.

In sum, the leg device 2, 2' can be easily operated between the folded and extended states by rotating the leg members 21, 21'. Thus, the table top 1 is easily attached to or detached from the leg device 2, 2' without tools. The detachable table device of the present invention can be disassembled into individual table top 1 and leg device 2, 2' when not in use. Preferably, the individual leg device 2, 2' is in the folded state. In this case, the detachable table device occupies a relatively small amount of space. Therefore, it is convenient to store and carry.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A detachable table device comprising:

a table top having a circumferential portion, said circumferential portion having an inner annular surface formed with a radially and outwardly extending annular engaging groove; and a foldable leg device detachably connected to said table top and operable between an extended state, where said table top is supported on said leg device, and a folded state, where said table top is detachable from said leg device, said leg device including a number (N) of leg members, where N is greater than or equal to 3, each of said leg members including an engaging end portion that is disposed movably in and engages releasably said engaging groove in said circumferential portion of said table top, and a pivot unit for interconnecting said leg members such that said leg members are pivotable relative to said pivot unit to be angularly equidistant when said leg device is in the extended state, and to be moved toward each other when said leg device is in the folded state;

wherein said circumferential portion of said table top is formed with a plurality of bumps disposed spacedly in said engaging groove such that said engaging end portion of each of said leg members is positioned by at least a corresponding one of said bumps when the leg device is in the extended state; and wherein said engaging end portion of one of said leg members is positioned between a corresponding adjacent pair of said bumps.

2. A detachable table device comprising:

a table top having a circumferential portion, said circumferential portion having an inner annular surface formed with a radially and outwardly extending annular engaging groove; and a foldable leg device detachably connected to said table top and operable between an extended state, where said table top is supported on said leg device, and a folded state, where said table top is detachable from said leg device, said leg device including a number (N) of leg members, where N is greater than or equal to 3, each of said leg members including an engaging end portion that is disposed movably in and engages releasably said engaging groove in said circumferential portion of said table top, and a pivot unit for interconnecting said leg members such that said leg members are pivotable relative to said pivot unit to be angularly equidistant when said leg device is in the extended state, and to be moved toward each other when said leg device is in the folded state;

wherein:

said pivot unit includes an upper pivot disc disposed on a bottom of said table top; and each of said leg members includes an upper connecting rod having a first end portion connected pivotally to said pivot disc, and a second end portion opposite to said first end portion and serving as said engaging end portion, and a supporting rod transverse to and connected to said upper connecting rod.

3. The detachable table device as claimed in claim 2, wherein:

said pivot unit further includes a lower pivot seat disposed under and aligned with said upper pivot disc; and each of said leg members further includes a lower connecting rod having a first end connected pivotally to said lower pivot seat, and a second end opposite to said first end and connected integrally to said supporting rod.

4. A detachable table device comprising:

a table top having a circumferential portion, said circumferential portion having an inner annular surface formed with a radially and outwardly extending annular engaging groove; and a foldable leg device detachably connected to said table top and operable between an extended state, where said table top is supported on said leg device, and a folded state, where said table top is detachable from said leg device, said leg device including a number (N) of leg members, where N is greater than or equal to 3, each of said leg members including an engaging end portion that is disposed movably in and engages releasably said engaging groove in said circumferential portion of said table top, and a pivot unit for interconnecting said leg members such that said leg members are pivotable relative to said pivot unit to be angularly equidistant when said leg device is in the extended state, and to be moved toward each other when said leg device is in the folded state;

wherein:

each of said leg members includes an upright leg rod, an engaging rod extending from top of said leg rod into said engaging groove in said circumferential portion of said table top and serving as said engaging end portion, a connecting rod transverse to said leg rod and having a pivot end, and a vertically extending sleeve connected fixedly to said pivot end of said connecting rod, said sleeves of said leg members being aligned with each other and being stacked in a vertical direction; and said pivot unit includes a pivot bolt extending through said sleeves of said leg members, and a nut connected threadedly to an end of said pivot bolt such that said leg members are limited to be rotatable about said pivot bolt.

* * * * *